United States Patent [19]

Hernandez-Marti et al.

[11] Patent Number: 5,052,941

[45] Date of Patent: Oct. 1, 1991

[54] INDUCTIVE-COUPLING CONNECTOR FOR A WELL HEAD EQUIPMENT

[75] Inventors: Ramon Hernandez-Marti, Vulaines sur Seine; Jean-Pierre Muller, Cesson, both of France

[73] Assignee: Schlumberger Technology Corporation, Houston, Tex.

[21] Appl. No.: 631,748

[22] Filed: Dec. 20, 1990

Related U.S. Application Data

[63] Continuation of Ser. No. 447,301, Dec. 7, 1989, abandoned.

[30] Foreign Application Priority Data

Dec. 13, 1988 [FR] France ..... 88 16353

[51] Int. Cl.[5] ..... H01R 4/60

[52] U.S. Cl. ..... 439/194; 166/65.1; 340/854

[58] Field of Search ..... 439/190, 191, 192, 193, 439/194; 340/853, 854, 855; 166/66, 65.1, 66.5

[56] References Cited

U.S. PATENT DOCUMENTS

| | | | |
|---|---|---|---|
| 2,379,800 | 7/1945 | Hare | 340/854 X |
| 3,079,549 | 2/1963 | Martin | 340/853 X |
| 3,090,031 | 5/1963 | Lord | 340/854 |
| 4,220,381 | 9/1980 | Van der Graaf | 439/194 |
| 4,605,268 | 8/1986 | Meador | 439/194 |
| 4,852,648 | 8/1989 | Akkerman et al. | 166/65.1 |
| 4,901,069 | 2/1990 | Veneruso | 340/853 |

FOREIGN PATENT DOCUMENTS

| | | | |
|---|---|---|---|
| 0162543 | 11/1985 | European Pat. Off. | 439/194 |
| 3402386 | 8/1985 | Fed. Rep. of Germany . | |
| 2422025 | 11/1979 | France . | |
| 2058474 | 4/1981 | United Kingdom . | |
| 2153410 | 8/1985 | United Kingdom . | |

OTHER PUBLICATIONS

World Oil Article, Jul. 1988, pp. 43–44.

*Primary Examiner*—Neil Abrams
*Assistant Examiner*—Khiem Nguyen
*Attorney, Agent, or Firm*—Henry N. Garrana; John H. Bouchard

[57] ABSTRACT

The invention relates to an electrical connector for transmitting electrical signals between the outside and the inside of a well having a well head (20) terminated by a valve assembly (10). The connector comprises at least two inductively coupled electrical coils (1A, 1B; 5A, 5B) whose respective winding axes are aligned with the axis (zz') of the well head. The coils are integrated in the fluid connector interconnecting the valve assembly and the well head, with one of the coils being releasably fixed to the valve assembly (10) while the other coil is releasably fixed to the well head (20).

4 Claims, 3 Drawing Sheets

INDUCTIVE-COUPLING CONNECTOR FOR A WELL HEAD EQUIPMENT

This is a continuation of application Ser. No. 07/447,301 filed Dec. 7, 1989 now abandoned.

BACKGROUND OF THE INVENTION

The invention relates to an electrical connector used in a well head equipment for transmitting electrical signals between the inside and the outside of the well head. Such a connector is particularly important in oil wells which are fitted with permanent sensors, e.g. temperature or pressure sensors, since it serves to feed the sensors with electrical power and to transmit the signals from the sensors to a remote point at the surface.

For the purposes of the present description, the term "well head equipment" is used to designate all of the equipment situated between the production tubing of a well and the flow line coming out of the valve assembly or "Christmas tree". This term thus covers both well head equipments which are disposed in the air and equipments which are underwater, e.g. offshore.

Well head equipments are essentially constituted by two parts: the well head and the valve assembly (or Christmas tree).

In conventional manner, electrical connections are provided through well head equipments by means of connectors comprising pins and sockets which mate with one another when the valve assembly is installed on the well head. The sockets are mounted inside the valve assembly and they are connected to the outside of the valve assembly via a sealed electrical feedthrough. The pins are mounted on the hanger from which the production tubing is suspended and they are connected to the annular space lying between the casing and the tubing via a second sealed feedthrough.

However, such a connector suffers from several drawbacks. Firstly, since it is at a distance from the axis of the well head, it is necessary for the valve assembly to be in exact angular alignment and for both axial and radial positioning tolerances to be exact when the valve assembly is put into place on the well head. In addition, insulation losses may occur in the presence of a conducting fluid such as sea water if it invades the space enclosing the connector. Finally, the connector contact is not protected from galvanic corrosion phenomena.

More recently, an article which was published in the July 1988 edition of the journal "World Oil", at pages 43–44 and entitled "Electrically Controlled Subsea Safety Valve" describes an inductively coupled electrical connection for transmitting electrical power through a subsea well head for the purpose of powering a safety valve situated in the tubing. To this end, inductive coupling is provided by means of two concentric coils both of which are placed beneath the hanger from which the tubing is suspended. An outer coil is wound around the well head, and an inner coil is wound around the tubing.

However, this inductive-coupling connection for a subsea well head also suffers from drawbacks. In this connection the outer coil is an integral portion of the fixed parts of the well head, and any repair work on the outer coil requires major disassembly of the items constituting the well head.

The object of the invention is to provide an inductive-coupling connector which avoids the above-mentioned drawbacks, which is reliable, which withstands attack from the medium in which it is immersed, and which is easy to maintain.

SUMMARY OF THE INVENTION

The present invention provides an electrical connector for transmitting electrical signals between the outside and the inside of a well having a well head surmounted by a valve assembly adapted to be releasably connected to the well head. A tubing hanger member is suspended in the well head. The valve assembly and the hanger member respectively include first and second engageable mating portions for providing fluid communication between the valve assembly and the tubing when the valve assembly is connected to the well head. The electrical connector comprises at least two electrical coils arranged on the first and second mating portions respectively with the axes of said coils being in alignment with the axis of the well head, for providing inductive coupling when said first and second mating portions are engaged. First electrically conductive means are mounted on the valve assembly for electrically connecting the first coil to the exterior of the valve assembly and second electrically conductive means are mounted on said hanger member for electrically connecting the second coil to a space of the well below the hanger member.

Preferably, the coils are disposed concentrically when the valve assembly is installed on the well head, with a first one of said coils being adapted to be inserted inside the second one of said coils.

In a particular embodiment, the first coil is wound around a tubular member fixed to the valve assembly. The second coil is wound inside a sleeve which overlies the tubing hanger. The first and second conductive means comprise electronic circuits including DC/AC and AC/DC converting means.

In another embodiment, said two coils are identical and are superposed when the valve assembly is installed on the well head.

BRIEF DESCRIPTION OF THE DRAWINGS

The invention will be best understood from the following description made with reference to the accompanying drawings, in which.

DETAILED DESCRIPTION

Figure 1:
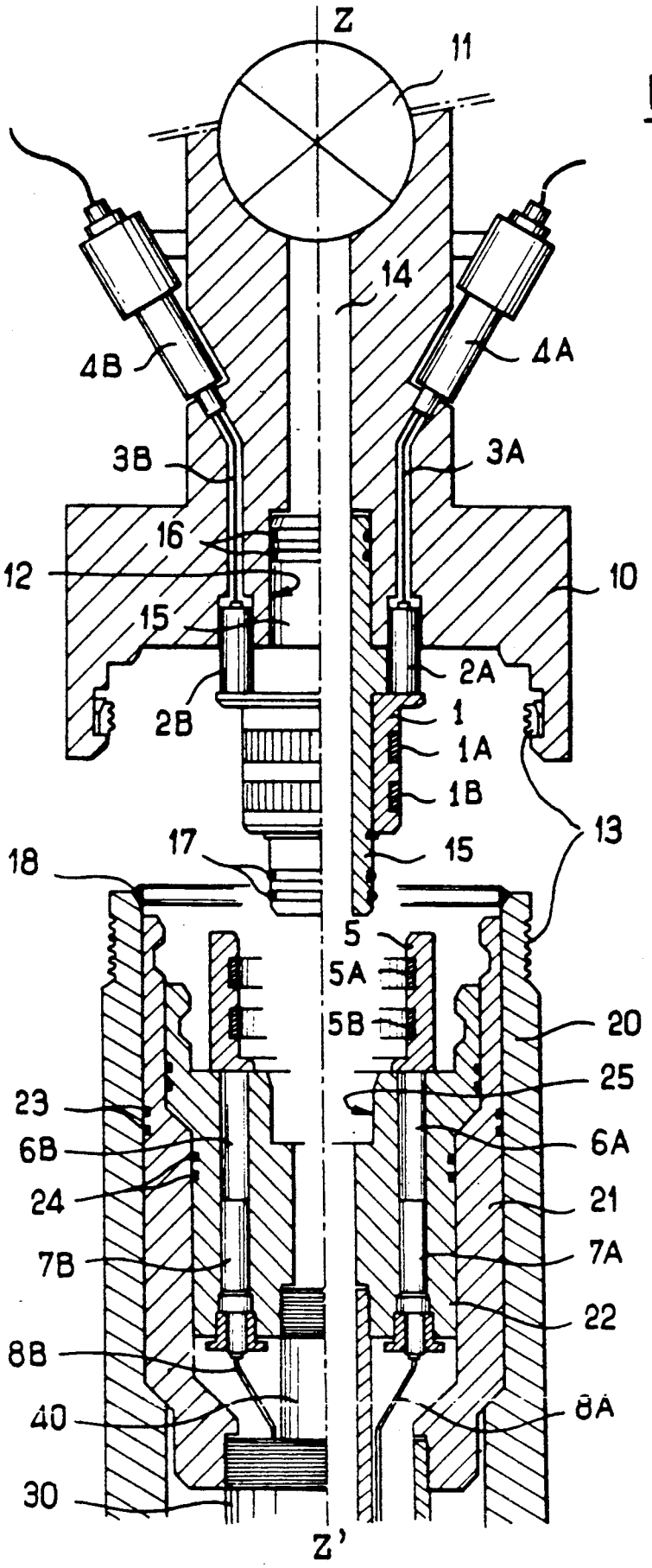
FIG. 1 is a diagram of a particular arrangement of an inductive-coupling connector in a well head equipment, with the valve assembly not yet connected to the well head.
Figure 2:
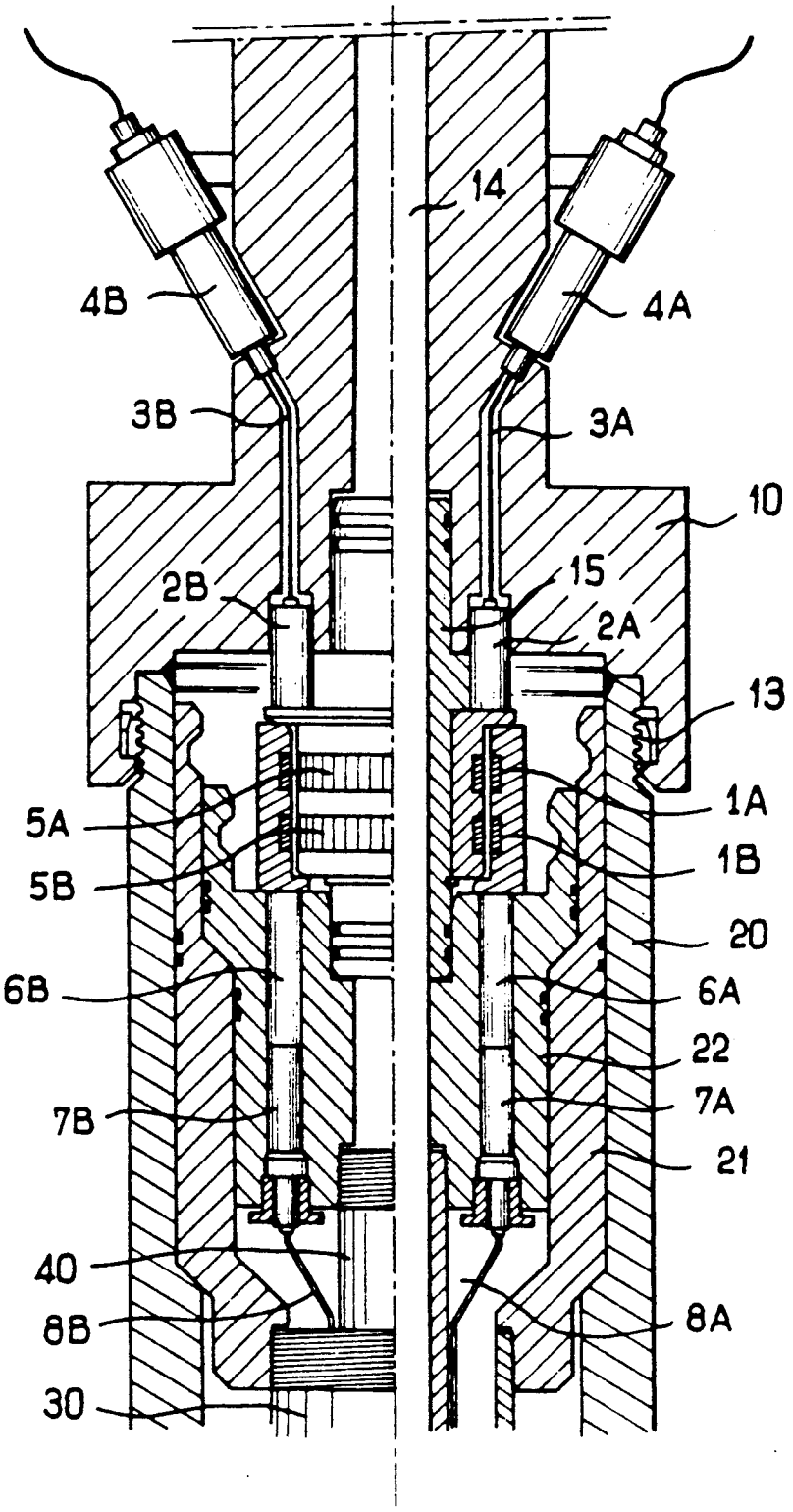
FIG. 2 shows the same items as FIG. 1, except that the valve assembly is connected to the well head.

With reference to FIGS. 1 and 2, a well head equipment essentially comprises a valve assembly 10 which is fixed in sealed manner on a well head 20 by means of a releasable locking assembly 13 and a sealing ring 18.

In conventional manner, the well head 20 is adapted to receive a casing hanger 21 for suspending the top end of a casing 30. Similarly, the casing hanger 21 is adapted to receive a tubing hanger 22 for suspending the top end of a production tubing 40. Sealing is provided firstly between the well head 20 and the casing hanger 21 and secondly between the hangers 21 and 22 by respective sealing rings 23 and 24.

The valve assembly 10 is fitted with valves 11 (with only one valve 11 being shown) for controlling the fluid flow from the well through the main duct 14. The bottom portion of the valve assembly 10 includes a bore 12 countersunk in the main duct 14 and receiving in sealed manner the top end of a tubular member 15 provided with sealing rings 16. The bottom end of the fluid connector member 15 is also provided with sealing rings 17 and is adapted to engage in sealed manner a mating portion of the tubing hanger 22 having a bore 25 therein. The tubular member 15 and the corresponding portion of the tubing hanger 22 are mating portions of a fluid connector for providing communication between the tubing and the valve assembly when the valve assembly is connected to the well head.

In accordance with the invention, the electrical connector comprises at least two coils 1A and 5A whose winding axes coincide with axis zz' of the well head 20, and which are fixed to the fluid connector mating portions on the valve assembly 10 and the tubing hanger 22 respectively.

In a particular embodiment of the invention, the inductive-coupling connector comprises firstly two electrical coils 1A and 1B wound around a first sleeve 1 which is fixed to the fluid connector tubular member 15, and secondly two electrical coils 5A and 5B wound inside a second sleeve 5 which is removably fixed to the top end of the tubing hanger 22.

When the valve assembly 10 is installed on the well head 20, the sleeve 1 is received in the sleeve 5 in such a manner that the coils 1A and 5A are disposed concentrically facing each other with a clearance of 2 mm therebetween, as are the coils 1B and 5B.

The winding of each coil is received in a groove which is at least partially coated in a highly ferromagnetic material such as ferrite. In addition, it is desirable to embed the windings in a sealing material which withstands pressure, temperature, and corrosion, e.g. an elastomer or a silicone-based resin.

The outputs from the coils 1A and 1B are connected to respective conventional sealed feedthroughs 2A and 2B which are connected in turn via conductors 3A and 3B to electronic circuits received in sealed boxes 4A and 4B situated on the outside of the valve assembly 10. These electronic circuits are described below with reference to FIG. 3.

Similarly, the outputs from the coils 5A and 5B are connected to second electronic circuits received in sealed boxes 6A and 6B located in the tubing hanger 22. The electronic circuits located in the boxes 6A and 6B are connected to sealed feedthroughs 7A and 7B which lead to conductors 8A and 8B situated in the annular space between the casing 30 and the tubing 40. The conductors 8A and 8B are connected to sensors (not shown) down the well.

The inductive-coupling connector as described above has the particular advantage of avoiding the need to position the valve assembly 10 accurately relative to the well head 20 while being put into place. It therefore constitutes a quick action electrical connector which is centered on and fully integrated with the fluid connector between the tubing hanger 22 and the valve assembly 10. In addition, the maintenance of such an electrical connector is facilitated by the fact that the coils 5A and 5B fixed to the tubing hanger are easily removable from the well head.

Figure 3:
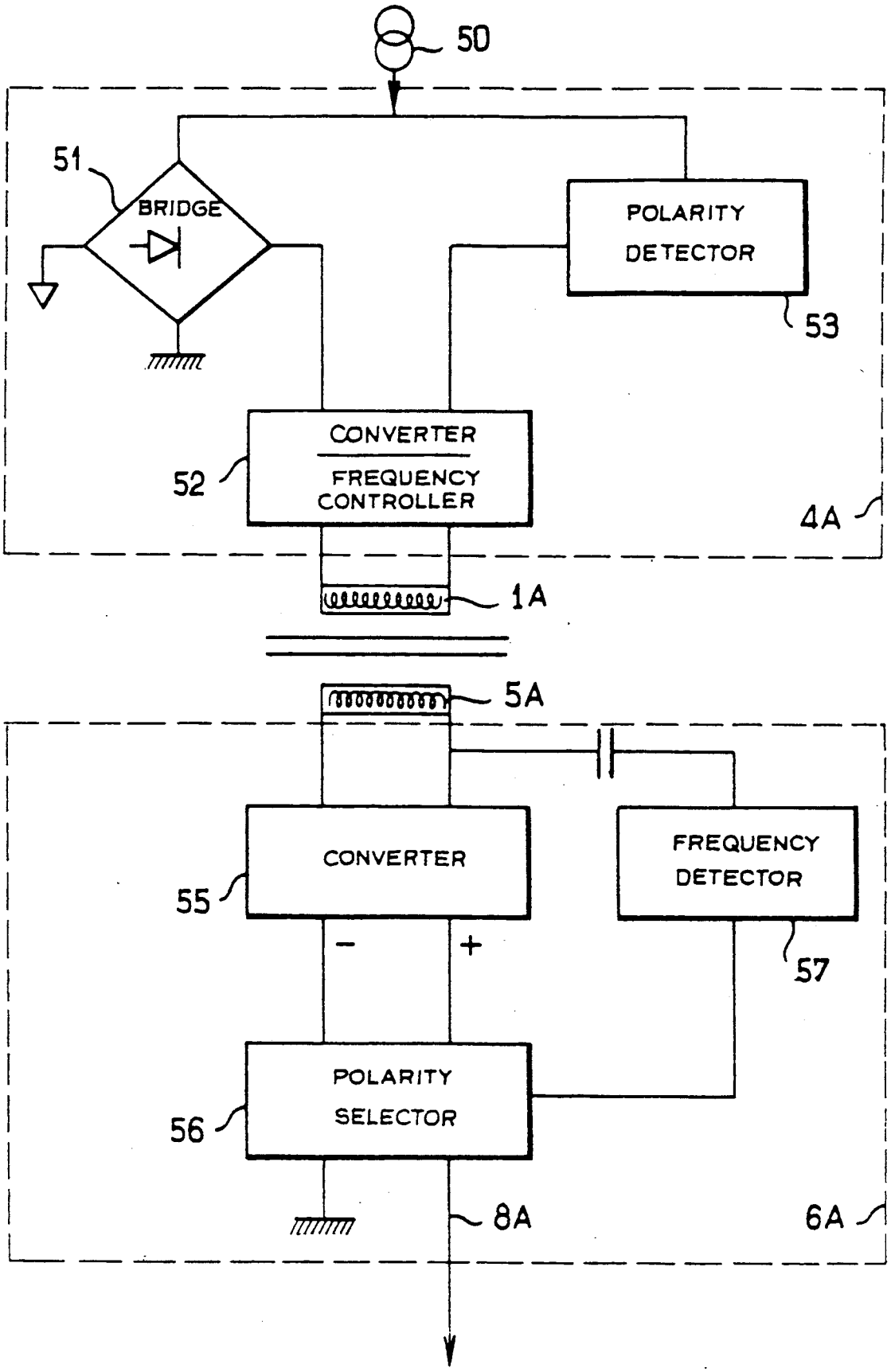
FIG. 3 is a block diagram of an electronic circuit associated with the inductive-coupling connector.

FIG. 3 is a block diagram showing the electronic circuit associated with the inductive-coupling connector and intended to provide an electrical connection between two sensors located downhole (not shown) and monitoring equipment on the surface (not shown). The two sensors may be used, for example, to measure temperature and pressure. In this case, the two sensors are supplied with electrical power by a common cable and the measuring signal to be sent to the surface is selected among the two possible measuring signals by reversing the power supply polarity. In order to simplify the description, only the circuit associated with the coils 1A and 5A is described.

Upstream from the connector, a first circuit which may be received in the above-mentioned box 4A, for example, is powered by a current source 50. The power supply electricity is rectified by a bridge 51 which feeds a converter 52 for transforming direct current into A.C. The frequency of the A.C. is controlled by a polarity detector 53 which is also powered by the current source 50. The output from the converter 52 feeds the coil IA directly.

Downstream from the connector, a second circuit received in the box 6A comprises a converter 55 powered by the coil 5A and serving to transform A.C. into D.C. A polarity selector 56 controlled by a frequency detector 57 selects the polarity of the D.C. applied to the cable 8A so as to select signals from one of the sensors down the well.

The voltage pulses generated by the sensors modulate the amplitude of the voltage at the terminals of the coil 5A via a synchronous impedance modulating converter 55. The converter 52 operates as a synchronous detector. It modulates the power supply voltage with voltage pulses after the power supply frequency has been filtered.

Such a circuit has the advantage of requiring only one inductive coupling connector for remote measurement from two sensors. As a result, the second circuit associated with the coils 1B and 5B could be used, for example, to serve as a backup circuit for use in the event of failure of the first circuit.

In another particular embodiment (not shown) the inductive-coupling connector comprises two coils of substantially identical diameter which are superposed when the valve assembly 10 is put into place on the well head 20.

Naturally, these two embodiments have been described purely by way of example, other ways of implanting the inductive-coupling connector could be envisaged without going beyond the scope of the invention.

We claim:

1. An electrical connector for use in a well having a well head equipment comprising a well head having an axis, a hanger member for suspending a production tubing to said well head, a production valve assembly adapted to be removably connected to said well head, said valve assembly and said hanger member respectively including first and second removably engageable mating portions for providing fluid communication between said valve assembly and said production tubing when said valve assembly is connected to said well head, the electrical connector comprising:

at least first and second electrical coil assemblies mounted on first and second sleeves respectively, said sleeves being releasably arranged on said first and second mating portions respectively with the axes of said coils being in alignment with the axis of the well head, for providing inductive coupling between said coils when said first and second mating portions are fluidly engaged;

first electrically conductive means mounted on said valve assembly for electrically connecting said first coil to the exterior of said valve assembly; and second electrically conductive means mounted on said hanger member for electrically connecting said second coil to a space in the well below said hanger member, wherein said first mating portion is a tubular member releasably fixed to said valve assembly and sealingly engageable with a corresponding cavity in said hanger member, said first coil being wound around said tubular member, and wherein said second coil is wound inside said second sleeve which overlies said tubing hanger and which surrounds said tubular member when said tubular member is sealingly and fluidly engaged with said hanger member.

2. A connector according to claim 1, wherein the coils are disposed concentrically when said first and second mating portions are fluidly and sealingly engaged, with one of said coils being adapted to be inserted inside the other one of said coils.

3. A connector according to claim 1, wherein said first electrically conductive means comprises an electronic circuit including DC to AC converting means.

4. A connector according to claim 3, wherein said second electrically conductive means comprises an electronic circuit including AC to DC converting means.

* * * * *